US006673391B1

(12) United States Patent
Perkett et al.

(10) Patent No.: US 6,673,391 B1
(45) Date of Patent: Jan. 6, 2004

(54) CERAMIC APPLICATOR DEVICE AND METHOD OF USE

(75) Inventors: Bruce A. Perkett, Newburgh, IN (US); James A. Schade, Evansville, IN (US); Clinton S. Zediak, Tarentum, PA (US); Jeffrey W. Bowling, Sidney, OH (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 10/216,325

(22) Filed: Aug. 9, 2002

(51) Int. Cl.[7] ..... B05D 1/28
(52) U.S. Cl. ..... 427/211; 427/428
(58) Field of Search ..... 427/211, 428; 118/227, 219, 247, 253

(56) References Cited

U.S. PATENT DOCUMENTS

| | | | | |
|---|---|---|---|---|
| 4,009,658 A | | 3/1977 | Heurich | |
| 4,301,730 A | | 11/1981 | Heurich et al. | |
| 4,967,663 A | | 11/1990 | Metcalf | |
| 4,977,830 A | * | 12/1990 | Fadner | 101/351.5 |
| 4,991,501 A | | 2/1991 | Yokoyama et al. | |
| 5,161,306 A | | 11/1992 | Nakahira et al. | |
| 5,293,817 A | | 3/1994 | Nussel | |
| 5,548,897 A | | 8/1996 | Link | |
| 5,857,950 A | | 1/1999 | Hycner | |
| 5,919,517 A | * | 7/1999 | Levendusky et al. | 427/211 |
| 5,927,207 A | | 7/1999 | Ghosh et al. | |
| 5,967,959 A | | 10/1999 | Niemi et al. | |
| 6,200,248 B1 | | 3/2001 | Vestola et al. | |
| 6,240,639 B1 | | 6/2001 | Hycner | |
| 6,341,559 B1 | | 1/2002 | Riepenhoff et al. | |
| 2002/0066405 A1 | | 6/2002 | Niemi et al. | |

OTHER PUBLICATIONS

Dennis J. Coyle, "Knife and Roll Coating", Liquid Film Coating, 1997, 539–542, Chapman & Hall, London (No Month Date).

* cited by examiner

*Primary Examiner*—Katherine A. Bareford
(74) *Attorney, Agent, or Firm*—Eckert Seamans Cherime Mellott; David Mayald; Daniel Cills

(57) ABSTRACT

A coated substrate, such as thick, coated metal sheet is made using a system (10) where a moving metal sheet substrate (12), preferably aluminum over 0.1 mm thick contacts an applicator roll (20) which has a non-deformable, micro-porous flat ceramic surface which is coated with a coating liquid (14) which is picked up, by a metering roll (18) and applied to the applicator roll (20) by contact with the coated metering roll, and where a backup roll (22) usually helps support the moving substrate.

11 Claims, 1 Drawing Sheet

CERAMIC APPLICATOR DEVICE AND METHOD OF USE

FIELD OF THE INVENTION

This invention relates to a method of applying coatings to metal substrates, utilizing direct contact with a flat, non-deformable applicator roll; and to substrates coated by such a method. In this invention, the metal substrate is metal sheet, not metal foil.

BACKGROUND OF THE INVENTION

Roll coating has been used for decades to apply liquid coatings to solid substrates for decoration, protection, and functionality. During that time, line speeds have increased, coating uniformity requirements tightened, environmental concerns heightened, and productivity goals raised. Roll coating has evolved according to the industry and coating requirements. Roll configurations vary tremendously; some of the variants are the number of rolls (two to five or more rolls per coating), the position of metering roll(s), coating feed location, coating against a backup roll or sheet tension, roll compositions, and the roll directions relative to each other and the substrate. Wet film thickness varies from 0.05–>100 micrometers and line speeds from 1–>500 m/min. Roll coating is used on paper, metal, plastic, and other substrates.

Liquid coatings are applied to substrates in a variety of methods including spray, dip, roll, knife, electrodeposition, vapor deposition, slot, and curtain coating. For metallic substrates, liquid coating is commonly transported to the applicator roll via direct contact with a bath, by contact with a second roll that has contact with a bath, by direct spraying onto the roll, and the like. The rolls can have a metal, plastic or other type surface depending on the material to be coated. The various rolls in a roll coater are usually given common names associated with their function. In the three roll configuration shown in FIG. 1 of this invention, the applicator roll 20 applies the coating to the web, and the backup, or impression roll 22 provides support for the web. If the back-up roll is deformable (rubber-covered) it is an impression roll while a non-deformable roll is a backup roll. The pickup/metering/fountain roll 18 lifts coating from the pan and meters coating with applicator roll 20. Since roll 18 has two functions, it can be called by more than one name. In addition, different industries commonly use different names for the same roll function, hence roll 18 is also called a fountain roll in the printing industry. Depending on the number of rolls in the configuration, additional terms such as transfer roll and spreading roll are commonly used to describe the roll function in a specific industry. The narrow gap between roll 18 and roll 20 is termed the metering nip and the narrow gap between roll 20 and the web is termed the coating nip. The back-up roll supports the web at the point of coating application. If space is maintained between the applicator roll and the web, the back-up roll is usually rigid, and there is no metal-to-metal contact. If the backup roll is forced into near-contact with the applicator roll, one of the two rolls are covered with deformable material to prevent metal to metal contact. Surfaces that move in the same direction at the point of nearest contact (rolls 18 and 20) are said to be moving in a forward direction, and those in opposite direction (roll 20 and the web) in a reverse direction. For the most uniform surface appearance, the applicator roll moves in a reverse direction for continuous web coating. A description of various roll combinations and descriptions of fluid dynamics can be found in *Liquid Film Coating*, Ed. S. F. Kistler et al. "Knife and Roll Coating" by Dennis J. Coyle, pp 539–542 (1997).

Ceramic surfaced metering rolls, having surface indentations to contain ink and the like, have long been used in the printing industry, as taught in U.S. Pat. Nos. 4,301,730 and 4,009,658 (Heurich et al and Heurich respectively). In Heurich the hard ceramic coating protects the roll from wear and permits a flatter cell profile. Other possible uses for this roll include "glue application rolls, rotogravure coating rolls and the like" but the substrates mentioned are compliant paper products. These inventions were improvements over rolls having a plated metal surface. In offset printing processes, water and ink are alternately fed to a plate surface where the ink selectively adheres to the picture portion. Yokoyama et al., in U.S. Pat. No. 4,991,501, used a ceramic faced dampening water feed roll with a flame sprayed layer of $Al_2O_3$ and/or $TiO_2$, and also containing $SiO_2$ as a hydrophilic, inorganic pore-occluding agent within ceramic surface occlusions. These rolls were seen as an improvement in terms of better wettability over flame sprayed $Cr_2O_3$ roll surfaces. The dampening water feed roll here is not in direct contact with substrate being coated or the plate cylinder.

In the area of coating metallic substrates for packaging and architectural end uses, metallic substrate are coated in one of two ways: as a continuous web or as approx. one $m^2$ (10 $ft^2$) sheets. A continuous "web" is rewound into a coil for subsequent trimming, slitting, or fabrication. Aluminum and steel are most commonly used as the substrate. Many coatings are applied on metal webs via forward or reverse roll coat with a deformable applicator roll. The applicator roll has a pliable covering about 5–50 mm thick made from polyurethane, EPDM rubber or similar pliable material. The covering Shore A hardness, referred to as durometer, is about 40–80 and the surface roughness $R_a$ is about 20–80 micro inches. ($R_a$ is determined by first finding a mean line parallel to the general surface direction, dividing the surface such that the sum of the areas formed above the line is equal to the sum of the areas formed below the line, and computing the surface roughness summing the absolute values of all the areas above and below the mean line and dividing by the sampling length.) This allows the applicator roll to transfer liquid coating to the metallic web and conform to any web surface irregularities or roll irregularities to ensure complete coverage at a uniform film thickness.

Deformable (rubber or polyurethane) applicator rolls are subject to wear and cause mottling, blisters, skips and eyehole defects due to swelling, burnishing, or exhibition of internal defects. When applicator rolls start to produce coating defects, the whole production line must be shut down and the applicator roll replaced. In addition to the cost of resurfacing the roll and finished product scrap, problems associated with stopping and starting a continuous line come to bear. Each line stoppage results in scrap generation and increases the chances for sheet breaks and dents. Another large cost is lost production time.

Two common applicator roll defects are mottling and edge blisters. Mottling occurs from wet coating thickness variations caused by the applicator roll. The applicator roll is thought to pick up oxides from the metal surface or become burnished from repeated contact with the metallic substrate. When a burnished applicator roll receives coating from the metering roll, the burnished surface does not carry as much coating and a low coating weight area results.

Edge blisters are another coating defect that results from deformable rolls wearing at the edge of the web. As the deformable roll covering deforms around the web edge, the web cuts the roll. After switching to a wider web, the cut in the applicator roll leaves an uneven amount of coating on the substrate, and the roll needs to be replaced or resurfaced before production can continue.

Other application problems with deformable applicator rolls, especially in high gloss waterborne colors, are small (1 mm×10 mm) areas of low coating weight and flow lines. The small areas are higher gloss than the surrounding coating and are eliminated only with difficulty by adjusting roll speeds and nip pressures. Flow lines, or ribbing instability from a forward metering roll nip, are unstable when using a deformable applicator roll.

A second mechanism for edge defects is called roll set—the tendency of the roll covering to retain its compressed dimensions after a stress has been removed. The deformable applicator roll has different compressive stress where the web contacts the web versus where it contacts the backup/impression roll or air. When switching to a wider web, the roll set leaves a step change in roll diameter and a resultant step change in coating weight at that point. The coating 'line' on the web requires immediate roll removal.

Deformable rolls are easily damaged by an inadvertent bump or cut, can contain bubbles or solid contaminants on or immediately under the surface, or collect oxides or organics from the metal web surface. These conditions are known to cause coating non-uniformities that require removal of the applicator roll. Unfortunately, it is very difficult to detect roll imperfections before installation and expensive in terms of time and materials when a roll fails, especially when a minor defect goes unnoticed for several hours production time.

The coating industry has also tried steel metering rolls with steel pickup/applicators but theses systems require a doctor blade, a deformable backup roll, high coating variability limits, or stringent safety procedures. Doctor blades can trap dried coating or contaminants and transfer the resulting coating defect to the web. A deformable backup roll is subject to the same wear issues related to handling varying widths of metallic webs and swelling from exposure to the coating.

Coating weight is controlled by the gaps between the rolls. If the coating thickness is less than 50 micrometers and coating uniformity is important, the total indicated runout of the rolls and bearings is significant to product quality. As roll length and weight increase, roll deflection further negatively impacts coating uniformity. Safety is always an issue when two non-deformable rolls are turning in close proximity at high speeds. Coating starvation can lead to heat generation and coating ignition, and roll misalignment can lead to metal fatigue and projectiles at failure.

Another problem with the current coating processes is the ability to quickly change from one width substrate to another. Currently, coaters start with the widest width customer web and work down to the narrowest width with the same coating system. This practice is not efficient because excess product inventory costs money via material costs, cancelled orders, and handling damage.

Deformable applicator rolls are currently chosen for a variety of properties, usually a balance between resistance to cuts from sharp metal edges, durometer for the proper 'footprint' on the substrate for smooth coating application, resistance to edge set to allow coating at both wide and narrow web widths, and resistance to burnishing from incidental contact with the metallic web. Unfortunately, deformable applicator rolls are optimized for one property at the expense of another, resulting in application problems via one of the above conditions.

One attempt to solve problems such as those described above is taught in U.S. Pat. No. 4,967,663 (Metcalf), which relates to metering rolls for depositing measured amounts of a liquid coating, such as ink or a protective material, on moving objects in a continuous process, where the objects are metal objects, such as cans. The rolls have a thick top of very porous, sintered ceramic, where incorporating organic filler and then burning the organic out during a ceramic sintering operation form the pores. This process solved problems associated with, among other prior operations, chrome-plated, engraved metal metering rolls. One advantage of the deliberately "pre-pored" ceramic rolls is that the formed pores are homogeneously distributed, so that simple regrinding provides a new useable porous surface. However, commercial experience has shown that a ceramic applicator roll in close proximity to the non-deformable can insert (supports can wall during the coating process) is not practical because of potential contact between the ceramic roll and can insert.

Heat dissipation is another problem with deformable applicator roll coverings. In addition to heat from shearing the coating in the coating nip (and metering nip if applicable), the flexing of the cover also generates heat. As one uses higher viscosity coatings, especially those containing materials that swell or chemically attack the roll covering, the heat generation increases and exacerbates the changes to the roll covering. Attempts to compensate for these changes, such as higher nip pressures, accelerate applicator roll failure.

Most of these patents do not describe how the coating liquid is applied/transferred to the roll for application on the substrate. Yokoyama et al., U.S. Pat. No. 4,991,501 described previously, immersed the master ceramic water discharge roll directly into the liquid and in contact with two non-immersed rubber rolls, one a metering roll and the other a water applying roll. In another application method, the water discharge roll is again immersed directly into the liquid and mounted under three additional rolls, one of rubber, contacting the immersed roll and another of rubber contacting the surface to be coated. FIGS. 3 and 4 of Yokoyama et al. illustrate a four-and five-roll configuration with a rubber-covered applicator roll.

In U.S. Pat. No. 5,548,897 (Link) an ink transfer roll having an ink metering, engraved $Al_2O_3$ surface, optionally overlaid with a ceramic such as $Cr_2O_3$, is in direct contact and immersed in the ink bath. The transfer roll is not in direct contact with the article being coated which is typical of many roll-coating operations. In U.S. Pat. No. 6,341,559 B1 (Riepenhoffet al.) an inking roll transfers ink to a porous printing form, preferably having a ceramic exterior surface, which transfers the ink to a rubber blanket cylinder which prints the image from the printing form cylinder onto a web substrate.

What is needed is an improved, simplified method and roll system to meter coatings on moving metallic substrates such as aluminum alloy sheet at various coating speeds, which would provide long runs before applicator roll change and uniform, flawless coatings on the substrate. What is unique about coating metal webs is the constantly varying width, gauge, and coating requirements. If all production parameters were similar, the coating application system could be optimized for it. For example, a constant width web might make slot coating the preferred method. As it is, frequent product changes are a fact of life now. If the same width were run all the time, a soft backup (impression) roll could be used. If the same coating were run all the time optimization of a direct forward gravure coater, like in the aluminum foil industry, or slot die coater for magnetic tape could be used. The reason roll coating has such a strong presence in metal finishing is its flexibility and low equipment cost. If the applicator roll is more rigorous, productivity increases. Gravure rolls accommodate about a 20% film weight variation with a single coating. Roll coating, however, is less subject to surface tension and substrate surface energy than gravure coating. Slot coating has potential for metallic substrates except the possibility for die damage is high and width adjustment is questionable. Attainment of <2.0 micrometer film weights while maintaining coating properties has proven to be difficult with extrusion coating.

SUMMARY OF THE INVENTION

It is one of the main objects of this invention to provide a simplified method to coat metal objects or substrates of sheet thickness (>100 micrometers) with or without using deformable rolls, where the method reduces production downtime and provides defect-free coatings.

These and other objects are accomplished by providing a method of coating a metal sheet substrate having a thickness greater than 0.1 mm comprising: providing a continuously moving sheet metal substrate having a thickness greater than 0.1 mm; providing a source of coating liquid; applying the coating liquid to a micro-porous, flat ceramic surfaced applicator roll, and contacting the metal sheet substrate directly with the coated, micro-porous, flat ceramic surfaced applicator roll to coat the substrate.

This method utilizes a hard-surfaced, non-deformable applicator roll against a thick, but roll bendable, hard, non-deformable metal substrate. This method can be a single or multiple pass process using one or more metering rolls or other pre-metering equipment to uniformly coat the ceramic surfaced applicator roll. The substrate can be support by a non-deformable backup roll opposite the applicator roll where the substrate passes between them, or the substrate can be supported by two or more passline rolls where the applicator roll is disposed between the passline rolls. The substrate is a non-deformable flat metal sheet having a thickness of from 0.1 mm to 0.8 mm and the coating rate/speed is from about 40 m/min to 500 m/min. The coating liquid can be a solution of protective resin, lubricating material, surface enhancing material, cosmetic enhancing material, and the like. These coatings can be heated at the end of the process, if necessary, at a temperature effective to cure or otherwise activate them, herein defined as 'cure'. The metering roll surface can be deformable, such as polyurethane. The applicator roll can have a wide range of average surface roughness ($R_a$) from about 0.03 to 35 micrometers, depending on the film weight that must be transferred to the substrate and the line speed. At higher line speeds, a high Ra value applicator roll may introduce air into the metering nip of a multi-roll coating configuration, therefore pre-metered delivery systems such as slot die, curtain, or enclosed coating feed chambers may be employed to prevent air entrainment in the bulk coating or applied coating. Within the above Ra range the ceramic roll will provide uniform, defect-free coating to the metallic web. This applicator roll directly contacts the moving substrate, allowing reduction of the number of rolls needed, while the applicator roll applies a pressure on the substrate of from about 0.3 $kg/cm_2$ to 3.0 $kg/cm^2$ (4 psi to 40 psi). The wrap angle of the metallic web contacting the applicator roll is between about 0 and 15 degrees, preferably between 2 and 10 degrees, where the wrap angle is the difference between where the sheet exits the applicator roll from an extended line from the incoming side of the web.

The invention also resides in a coated metal sheet substrate having a thickness greater than 0.1 mm, made by providing a continuously moving metal substrate having a thickness greater than 0.1 mm; providing a source of coating liquid; metering the coating liquid on to a micro-porous, flat ceramic surfaced applicator roll; and contacting the metal substrate directly with the coated, applicator roll, to coat the substrate. The metal is preferably aluminum alloy sheet. The invention is not applicable to "metal foil" which is generally defined as having a thickness less than 100 micrometer (0.001 mm).

This invention may utilize a deformable metering roll, but now the metering roll is removed from direct contact with the metallic web and is not subject to the same wear. As such, the applicator roll, contacting the metal sheet web, can have a higher durometer rating, which either lowers metering nip forces (longer roll life) or allows one to apply higher solids coatings (cost savings) at the same dry film thickness. The usual wet coating thickness is from about 5 to 100 micrometers.

Other aspects and advantages of the invention will occur to persons skilled in the art from the drawings and following detailed description.

BRIEF DESCRIPTION OF THE DRAWINGS

The following non-limiting drawings will better enable one skilled in the art to understand the detailed description, where.

DETAILED DESCRIPTION OF PREFERRED EMBODIMENTS

Figure 1:
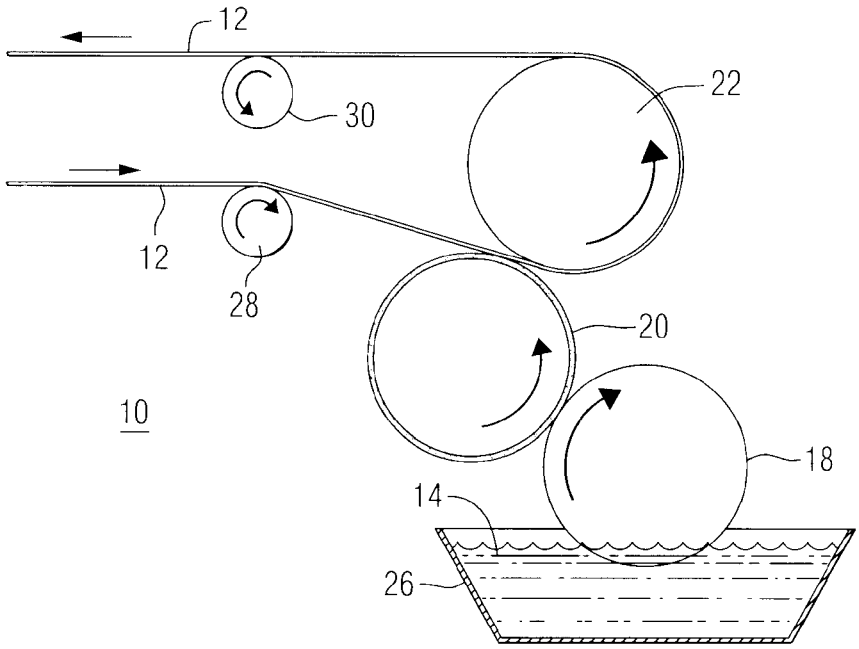
FIG. 1 is a schematic drawing showing operation of one embodiment of the system of this invention for coating a single side of a moving substrate.

Referring now to FIG. 1, in the coating system 10 of this invention, a continuously fed and moving fairly thick metal substrate sheet 12 passes over a pass, which can bend to roller pressure but is considered "non-deformable", in contrast to thin metal foil, paper, and the like line roll 28 to directly contact non-deformable applicator roll 20. The substrate can be steel, aluminum, tin, copper, or the like sheet, preferably aluminum alloy sheet such as that containing (greater than) >90% aluminum. The substrate 12 preferably has a flat top and bottom surface. Substrate thickness for the continuous process of this invention will be between about 0.1 mm to 0.8 mm, preferably between about 0.100 mm to 0.500 mm. The coating rate will vary widely depending on the coating liquid viscosity and coating thickness desired, but will usually be from about 40 m/min to 500 m/min, preferably from about 200 m/min to 400 m/min.

A source of coating liquid 14 is provided and is usually held in an appropriate type container 26, although the coating liquid may, in some instances, be sprayed on an applicator roll. The coating liquid 14 can be either water-borne or solvent borne. The coating liquid is usually a protective material, such as a wax, resin or polymeric solution, dispersion or suspension such as epoxy, polyester, or acrylic, or a material effective to lubricate the substrate surfaces, such as petrolatum or a surface enhancing material effective to enhance the surface and/or cosmetic properties of the substrate surfaces. The liquid coating will have a viscosity of about 20–6000 centipoise (where one-thousand centipoises (cP) equals one Pascal-second). These coatings, once applied, can be air-dried, UV (ultraviolet) or EB (electron beam) cured, heat cured, or the like, to provide the desired resulting "cured" coating. Some coating materials can be, for example, a solvent borne solution of vinyl, a solvent borne epoxy resin, or a waterborne polyester.

The liquid coating 14 is preferably contacted with/applied to a metering roll 18 to coat the metering roll. This metering roll 18, which term is used herein as the roll to which liquid coating is initially applied, can be of any type effective to carry the coating liquid to the applicator roll 20, which term is used herein as the roll which applies the coating to the moving substrate. The metering roll 18 can be porous or non-porous, and preferably deformable such as polyurethane covered. The material used depends upon the type coating liquid, coating viscosity, desired film weight, and line speed. Alternately, coating can be applied in some instances to the non-deformable applicator roll 20 in a different manner, such as slot die, enclosed doctor blade, or curtain coat to provide the proper uniformity of coating to maintain a stable coating nip. Such pre-metered coating systems eliminate the need for deformable roll coverings, allow rapid width/coating changes, and protect the expensive dies from damage during sheet breaks and the like. The liquid 14 is held in an appropriate container 26 as shown in FIGS. 1 and 2 and the metering roll moves in the forward direction with applicator roll 20, to provide smooth pick-up of coating liquid 14.

Figure 2:
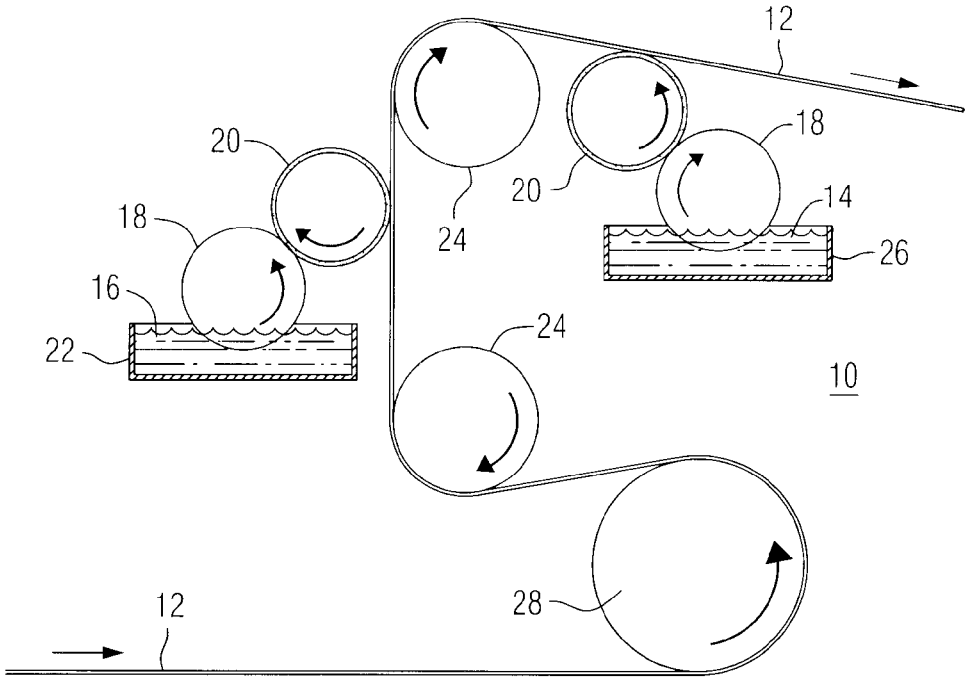
FIG. 2 is a schematic drawing showing operation of another embodiment of the system of this invention for coating both sides of a moving substrate.

The applicator roll, 20 preferably reverse roll coats (rolls opposite to substrate) the moving substrate 12, as shown in both FIGS. 1 and 2 because the wet film thickness is more uniform than with forward roll coating due to the location of the film split meniscus. Forward roll coating with a non-deformable applicator roll is possible providing the coating hydrodynamic forces keep the surfaces separate. The applicator roll 20 preferentially has a sintered, micro-porous, flat, ceramic surface. Particularly useful ceramic oxides are selected from the group consisting of aluminum, titanium, zirconium, and chrome oxides or and mixtures thereof, but preferably chrome oxide. Other appropriate wear resistant surfaces include, but are not limited to, cermet coatings such as tungsten carbide, tungsten chrome carbide, and chrome carbide. The surface pore openings can range from about 1 micrometers to about 300 micrometers. A stable coating liquid meniscus is provided between the micro-porous surface and the moving metal substrate to provide smooth layering and a continuous flaw free coating. Thus, the micro-surface of the applicator roll is an integral part of the method and assures a uniform, continuous, homogenous, smooth coating, rather than a non-uniform lumpy type coating which might result from a large pore/rough surface. It is believed that the smoothness of the applicator roll is important to maintain a stable coating bead/meniscus at high line speeds. As the applicator rolls turns faster, the tendency to drag air into the bead can disrupt the bead and cause a coating perturbation, or simply 'whip' air into the heretofore bubble-free liquid. The applicator roll will apply a pressure on the substrate of from about 0.3 kg/cm$^2$ to 3.0 kg/cm$^2$ (4 psi to 40 psi).

The applicator roll 20 can be located/disposed directly opposite the metering roll 18 and a backup roll 22 as shown in the embodiment of FIG. 1, where for example only one side of the substrate is to be coated. The backup roll fully supports the moving substrate. As mentioned previously, it is advantageous to locate the applicator roll 20 in close proximity, but not to permit actual contact with the backup roll 22, for both safety reasons and coating weight variations from roll out of roundness. It is helpful to arrange the rolls such that a wrap angle of about 2 to 10 degrees is maintained to ensure a stable coating process. Wrap angle is the portion of the roll circumference that is covered by the web, expressed in degrees. FIG. 1 shows a reverse roll coat configuration, and this is one of many possible configurations for roll coating metallic substrates. For best coating appearance and uniformity, those skilled in the art move the applicator roll in the opposite direction as the web which results in a smoother coating. Depending on coating flow after application and quality standards, forward roll coating is may be practical. An additional top guide roll 30 is also shown in FIG. 1.

FIG. 2 illustrates a coating configuration where both sides of the metallic web are reverse roll coated under sheet tension, where in that embodiment, both sides of the moving substrate are coated with the same or different coating liquids 14 and 16, using two separate metering rolls 18 and two separate ceramic surfaced applicator rolls 20, where each applicator roll is spaced apart from dual backup rolls 24. Again, as shown the metering rolls 18 and applicator rolls move in opposing directions similarly to FIG. 1. In FIG. 2, the applicator rolls 20 move in the opposite direction as the moving substrate 12 which initially passes over optional turn roll 28. As shown, the initial (first to coat) applicator roll is disposed between at least two, here dual idler rolls 24 The invention will now be further described in the following non-limiting experimental examples.

EXAMPLE 1

This Example illustrates a coating application using a ceramic-coated applicator roll in combination with a urethane metering roll where the following conditions applied:

| | |
|---|---|
| Metering roll: | 55 durometer urethane, diameter =0 15 cm |
| Applicator roll: | fairly rough ceramic-coated steel roll (Ra = 115 micro inches, just under about 35 micrometers) |
| Web: | 30 cm wide x 216$\mu$ chrome-treated 5182H19 aluminum (>90% Al) |
| Coating: | clear epoxy coating, 25 wt. % solids, solvent borne |
| Viscosity: | 120–130 cP at 77° F. |
| Line Conditions: | 55 m/min with curing oven at 280° C., metering roll speed 35% of line speed |

| Test | Applicator speed | Wrap angle ° | Wet thickness | Look |
|---|---|---|---|---|
| 1 | 120% | 5 | 28 | 10 |
| 2 | 120% | 10 | 33 | 10 |

Wet coating thickness from 5–40 micrometers

At most conditions, the applicator roll was kept separate from the metallic web via hydrodynamic lubrication and the ceramic roll did not scratch the aluminum substrate. If the coating viscosity was too low the ceramic applicator roll unacceptable contacted and scratched the aluminum substrate.

The following description applies to the above terms: "Application Speed" means the speed of the applicator roll as a percent of the line speed. "Wrap angle" is the portion of the roll circumference that is covered by the web, expressed in degrees. "Wet thickness" is the initial coating thickness in microns. "Look" is a subject rating where 10 is a perfect appearance and 0 is the worst. "Coating viscosity" is expressed in centipoise at room temperature.

EXAMPLE 2

This Example illustrates a coating application using a ceramic-coated applicator roll in combination with a urethane metering roll where the following conditions applied:

| | |
|---|---|
| Metering roll: | 55 durometer urethane, diameter = 15 cm |
| Applicator roll: | ceramic-coated steel roll (Ra = 0.6 micrometers) |
| Web: | 75 cm wide x 430$\mu$ chrome-treated aluminum (>90% Al) |
| Coating: | pigmented solvent borne polyester coating, 70 wt. % solids |
| Viscosity: | 70 cP at 77° F. |
| Line Conditions: | 120 m/min with curing oven at 280° C., metering roll speed 50% of line speed |

| Test | Applicator speed | Wrap angle ° | Wet thickness | Look |
|---|---|---|---|---|
| 1 | 150% | 5 | 30 | 10 |

EXAMPLE 3

This Example illustrates a coating application using a ceramic-coated applicator roll in combination with a urethane metering roll where the following conditions applied:

| | |
|---|---|
| Metering roll: | 55 durometer urethane, diameter = 15 cm |
| Applicator roll: | ceramic-coated steel roll (Ra = 0.6 micrometers) |
| Web: | 75 cm wide x 430$\mu$ chrome-treated aluminum |
| Coating: | (>90% Al) water borne primer, 38 wt. % solids |
| Viscosity: | 40 cP at 77° F. |
| Line Conditions: | 50 m/min with curing oven at 280° C., metering roll speed 100% of line speed |

| Test | Applicator speed | Wrap angle ° | Wet thickness | Look |
|---|---|---|---|---|
| 2 | 150% | 5 | 12 | 10 |

It should be understood that the present invention may be embodied in other forms without departing from the spirit or essential attributes thereof, and accordingly, reference should be made to both the appended claims and to the foregoing specification as indicating the scope of the invention.

What is claimed is:

1. A method of coating a metal sheet substrate having a thickness greater than 0.1 mm comprising:

(a) providing a continuously moving metal sheet substrate having a thickness greater than 0.1 mm;

(b) providing a source of coating liquid;

(c) applying the coating liquid to a micro-porous, flat, ceramic surfaced applicator roll; and (d) contacting the metal substrate with the coated, micro-porous, flat ceramic surfaced applicator roll, to coat the substrate.

2. The method of claim 1 wherein the substrate is aluminum alloy having a thickness of from about 0.1 mm to 0.8 mm and the coating rate is from about 40 m/minsec to 500 m/minsec.

3. The method of claim 1, wherein the coating liquid is selected from the group consisting of protective resin, lubricating material, surface enhancing material, and cosmetic enhancing material, and the substrate is coated on one side.

4. The method of claim 1, wherein the applicator roll has a smooth surface with an Ra value of about 0.03 to 35 micrometers and in step (d) contact with the substrate provides continuous coating on the substrate.

5. The method of claim 1, wherein the ceramic surface of the applicator roll contains sintered ceramic oxides selected from the group consisting of aluminum oxides, titanium oxides, zirconium oxides, chrome oxides, tungsten carbide, tungsten chrome carbide, chrome carbide and mixtures thereof, and the applicator roll rotates in the opposite direction as the moving substrate.

6. The method of claim 1, wherein two sides of the substrate are coated by contacting each side with the applicator roll.

7. The method of claim 1, where at least one backup roll is present to help support the moving substrate.

8. The method of claim 7, where a backup roll is disposed opposite the applicator roll and the moving substrate moves between the rolls.

9. The method of claim 7, where at least two rolls help support the moving substrate and at least one applicator roll is disposed between two of the rolls where the moving substrate moves between the rolls.

10. The method of claim 1, where the coating liquid is disposed in a container.

11. The method of claim 1, where the coated substrate is heated.

* * * * *

UNITED STATES PATENT AND TRADEMARK OFFICE

CERTIFICATE OF CORRECTION

PATENT NO. : 6,673,391 B1 
DATED : January 6, 2004
INVENTOR(S) : Bruce A. Perkett et al.

It is certified that error appears in the above-identified patent and that said Letters Patent is hereby corrected as shown below:

Column 10,
Line 22, after "applicator roll" insert -- has a micro-surface with surface pre openings of from about 1 micrometer to about 300 micrometers to provide a stable coating meniscus between the micro-surface and the moving substrate, and --.
Line 27, after "substrate" insert -- at the point of application of the coating liquid --.
Line 41, after "disposed in a" delete "container." and insert -- container, and the coating liquid is selected from the group consisting of water borne and solvent borne coating liquids. --.
Line 43, after "heated" insert -- after coating --.

Signed and Sealed this

Twelfth Day of October, 2004

JON W. DUDAS
*Director of the United States Patent and Trademark Office*